US006574880B2

(12) United States Patent
Lombardo

(10) Patent No.: US 6,574,880 B2
(45) Date of Patent: Jun. 10, 2003

(54) MARKER FOR INDICATING SITE FOR A FASTENER

(76) Inventor: Jeffrey B. Lombardo, 571 W. Wilson Rd., Pahrump, NV (US) 89041

( * ) Notice: Subject to any disclaimer, the term of this patent is extended or adjusted under 35 U.S.C. 154(b) by 0 days.

(21) Appl. No.: 10/058,017

(22) Filed: Jan. 29, 2002

(65) Prior Publication Data

US 2002/0066200 A1 Jun. 6, 2002

Related U.S. Application Data

(63) Continuation-in-part of application No. 09/332,858, filed on Jun. 15, 1999, now abandoned.

(51) Int. Cl.[7] ..... B25H 7/00; B43L 13/00

(52) U.S. Cl. ..... 33/666; 33/613

(58) Field of Search ..... 33/666, 528, 34, 33/667, 668, 669, 670, 671, 672, 679, 562, 574, 613, 645, 18.1; 116/211, 209

(56) References Cited

U.S. PATENT DOCUMENTS

| | | | | | |
|---|---|---|---|---|---|
| 2,675,617 | A | * | 4/1954 | Goldman et al. | 33/18.1 |
| 4,244,549 | A | | 1/1981 | Oldfield | |
| 4,382,337 | A | * | 5/1983 | Bendick | 33/613 |
| 4,457,485 | A | * | 7/1984 | Landt | 33/613 |
| 4,641,807 | A | | 2/1987 | Phillips | |
| 4,804,161 | A | | 2/1989 | Wallo | |
| 5,069,412 | A | | 12/1991 | Jacob | |
| 5,080,317 | A | | 1/1992 | Letizia | |
| 5,103,573 | A | | 4/1992 | Ehling et al. | |
| 5,437,429 | A | | 8/1995 | Atlas | |
| 5,454,542 | A | | 10/1995 | Hart | |
| 5,477,620 | A | | 12/1995 | Barnett | 33/666 |
| 5,509,213 | A | | 4/1996 | Kelly et al. | |
| 5,542,641 | A | | 8/1996 | Donovan | |
| 5,867,917 | A | | 2/1999 | Karon | |

* cited by examiner

*Primary Examiner*—Christopher W. Fulton
(74) *Attorney, Agent, or Firm*—Richard L. Huff

(57) ABSTRACT

A solid marker for indicating a location to place a fastener for an object to be placed on a supporting surface. The marker, preferably made of chalk, includes a front containing at least one pointed tip for marking the supporting surface and a back, adhesive, surface for adhering the marker to the object to be mounted. The adhesive surface is covered by a release layer when the marker is not in use.

17 Claims, 3 Drawing Sheets

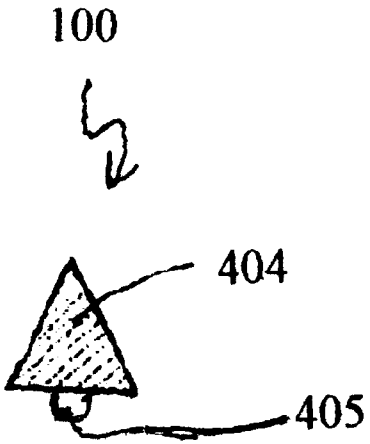
Fig. 6
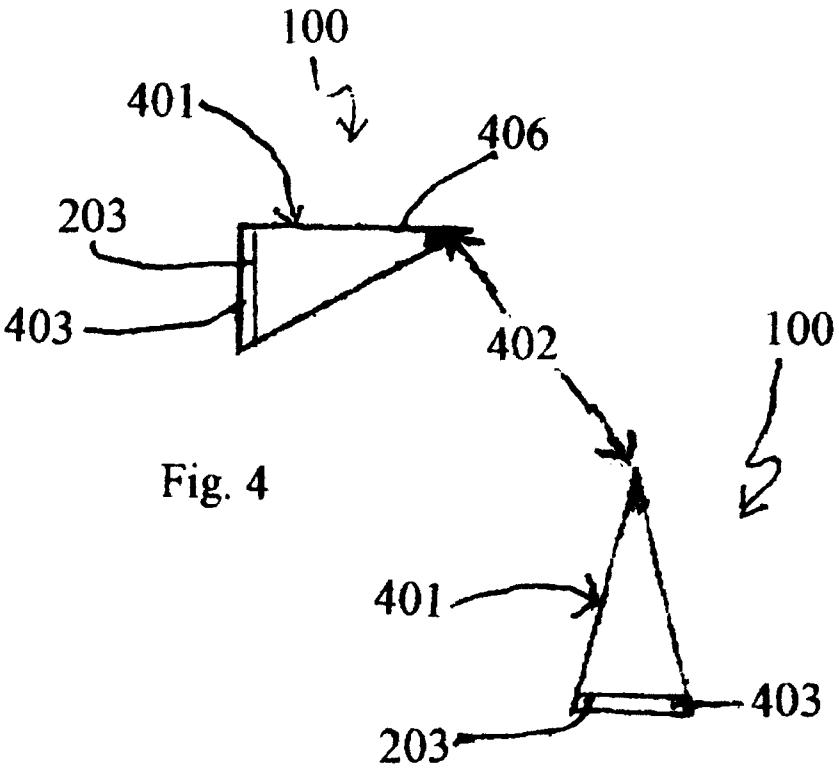
Fig. 4
Fig. 5

MARKER FOR INDICATING SITE FOR A FASTENER

CROSS-REFERENCE TO RELATED APPLICATIONS

This application is a continuation-in-part of my application, Ser. No. 09/332,858, filed Jun. 15, 1999, now abandoned.

BACKGROUND OF THE INVENTION

1. Field of the Invention

The present invention relates generally to marking devices. More particularly, the invention relates to an adhesively applied marker for indicating a location on a supporting surface to place a fastener.

2. Description of the Related Art

In homes and businesses around the world, objects are hung on interior and exterior supporting surfaces of buildings. Some of these objects are merely decorative, such as pictures, paintings, or displayed documents. Others may serve functions such as shelving, smoke detectors or wall mounted appliances. Many of these objects have provisions to be supported by a hidden fastener or support, specifically a support that is hidden by the object, itself. Framed objects, such as paintings or other pictures present a particular problem when one is attempting to locate a site to place the fastener, as the location for the fastener is obstructed from view while the object is held against the supporting surface in the desired location. While many devices are known for hanging objects on walls with hidden fasteners, the common problem with such devices is that they employ site markers which are pins, pencils, or pens. Such site finders either put holes in the wall or mark up the wall in a manner which is difficult to remove. This is particularly serious when several attempts are necessary to discover the ideal location for a framed article in walls covered with wallpaper. The present invention provides a novel solution to this problem by temporarily placing a marker directly on the back of the object at the location of the fastener in order to mark the location of the fastener on the wall.

U.S. Pat. No. 4,244,549 discloses a self-straightening picture hanger designed to level and support a picture frame using a single support nail. The method of locating the nail is not discussed.

U.S. Pat. No. 4,641,807 discloses a three-dimensionally adjustable picture hanger which overcomes the problem of finding a fastener location by first attaching an adjustable hanger to the wall. The specific location of the picture can then be slightly adjusted using the hanger. This reference does not disclose a method for initially positioning the disclosed threaded support.

U.S. Pat. No. 4,804,161 is drawn to a hanging device for picture frames or like objects and a method of using this device. This device includes prongs for supporting a picture frame and is mounted to a wall using two fasteners in slots for finally adjusting the support. No method is taught for initially locating the fasteners.

U.S. Pat No. 5,069,412 discloses a picture hanger which has prongs for supporting a picture frame and is mounted to a wall using fasteners that can be driven through a combination of horizontal or slanted holes. While this device provides a wide range of supporting strengths, no method is taught for initially locating the fasteners to avoid the reinstallation of the hanger.

U.S. Pat. No. 5,080,317 shows a picture anchoring assembly. The assembly is actually a stabilizing anchor in the form of a fastener with two sharp ends and a leveling device for installing the anchor on the picture frame. The anchor stops the picture from skewing once the picture is level. The patent does not discuss a method to predetermine the position of the fastener on the wall.

U.S. Pat. No. 5,103,573 discloses another type of device for hanging pictures. This device is used to install two hooks level with one another to support a wire attached to the rear of a picture. While a method for predetermining the location of the fasteners is discussed (col. 3, line 48 to col. 4, line 36), the method requires a number of measurements, and does not involve placing a marker on the back of the picture.

U.S. Pat. No. 5,437,429 discloses a self-adjusting, two-piece picture hanger which allows the angled insertion of a fastener through a top position while a lower position is permitted to pivot for self adjustment. This patent does not disclose a method for initially locating the fastener.

U.S. Pat. No. 5,454,542 discloses am apparatus and method for hanging frames. The apparatus is basically a bracket with a level for premounting the bracket to a wall. The position of the fasteners on the wall, relative to the frame is not a concern, and a method of marking this position is not discussed.

U.S. Pat. No. 5,477,620 discloses a marker being in the form of a ring and made up of a foam-like substance impregnated with powdered chalk or dye or microspheres of dye. One flat surface of the marker is coated with an adhesive, and the other flat surface contains an impermeable barrier. The marker is adhesively applied to an assembly, which is positioned and repositioned at a bolt engagement site until the desired site is found. The impermeable barrier layer is then removed and the assembly is placed in its desired final position and force is applied to coat the desired position with chalk dust or dye. Drill holes are then made at the indicated sites. The marker of this patent is complicated, being made up of a foam-like carrier and a marking material. Additionally, the marking material will be used up upon application of the marker a limited number of times.

U.S. Pat. No. 5,509,213 discloses a picture hanger aid and aligning device. In this invention, a picture is hung from hooks on a horizontal member of the device. A handle is provided to support the device and the picture in the desired location to hang the picture. The picture can than be removed from the device, and the locations for the fasteners can be marked. This device is directly concerned with the problem addressed by the present invention. In contrast with the present invention, however, this device is large and bulky, and is difficult for a single person to operate, requiring one-handed manipulation of the picture while holding the device.

U.S. Pat. No. 5,542,641 is drawn to a wall hanger, mounting kit, and method. The hanger uses pins as mounting fasteners to minimize damage to the wall. Various embodiments for securing different types of objects to the wall are disclosed. No mention of predetermining the locations of the pins is made. The repeated use of pins would leave a plurality of holes in the wall, which would be unsightly when the framed article is removed.

U.S. Pat. No. 5,867,917 discloses a complex picture hanger locating device which attaches to a picture to be hung. The located hanger site will be marked with a pin, pencil, or pen, which, if multiple markings are made, can produce unsightly walls, especially if the walls are papered.

SUMMARY OF THE INVENTION

The present invention is drawn to a marker made of chalk or other easily erasable marking material for indicating a location to place a fastener for an object mounted on a supporting surface. For purposes of describing this invention, the term "supporting surface" includes, but is not limited to, an interior wall, an exterior wall, or ceiling of a commercial building, residential building, outbuilding, or ship. For purposes of describing the present invention, the term "object" refers to a picture, a mirror, a certificate or other displayed document, a calendar, shelving, smoke detector, wall mounted appliance, or other like objects.

The marker includes a front surface containing a pointed tip for marking the fastener site on a supporting surface and a back surface coated with adhesive. When not in use, the adhesive is covered with a release layer. For use, the release layer is peeled off to expose the adhesive and the marker is attached to the back of the object to be mounted. For purposes of this description, the "back surface" of the surface-mounted object is that surface which will face toward the supporting surface while the "front" of the surface-mounted object is that surface which will face away from the supporting surface. The shape of the marker is preferably that of an arrow, although any shape with at least one pointed tip may be used.

In use, the adhesive surface of the marker is adhered to the back of the object to be mounted, with the pointed tip of the marker directly on or close to the location of a fastener which will engage the object to be mounted. Conventional fasteners, such as picture hooks, nails, or screws, are well known in the art. In some cases the object to be mounted will have brackets, and the pointed tip of each marker is aligned with the place each fastener will engage the brackets. When the object is to be mounted uses a hanging mechanism such as a cord, wire, or string, the hanging mechanism may be routed over the pointed tip of each marker. The adhesive is partially tacky, so that the marker is supported on the back of the object, but can easily be removed and reapplied.

Once the marker is in place on the back of the object to be mounted, the object can be held up adjacent the supporting surface by an installer. The most desirable position for the object can then be ascertained. Once the most desirable position is ascertained, the object can be pushed against the supporting surface until the pointed tip of the marker contacts the supporting surface, leaving a small mark where the fastener is to be placed. The object is then taken away from the supporting surface and a fastener installed at the site of the mark. Because of the nature of the marking material, multiple markings may be easily erased and do not leave holes or hard-to-erase markings that mar the supporting surface.

BRIEF DESCRIPTION OF THE DRAWING

FIG. 4 is an elevational side view of an alternate marker of this invention.

FIG. 5 is an elevational top view of the alternate marker of this invention.

FIG. 6 is an elevational back view of the alternate marker of this invention.

DESCRIPTION OF THE PREFERRED EMBODIMENTS

Figure 1:
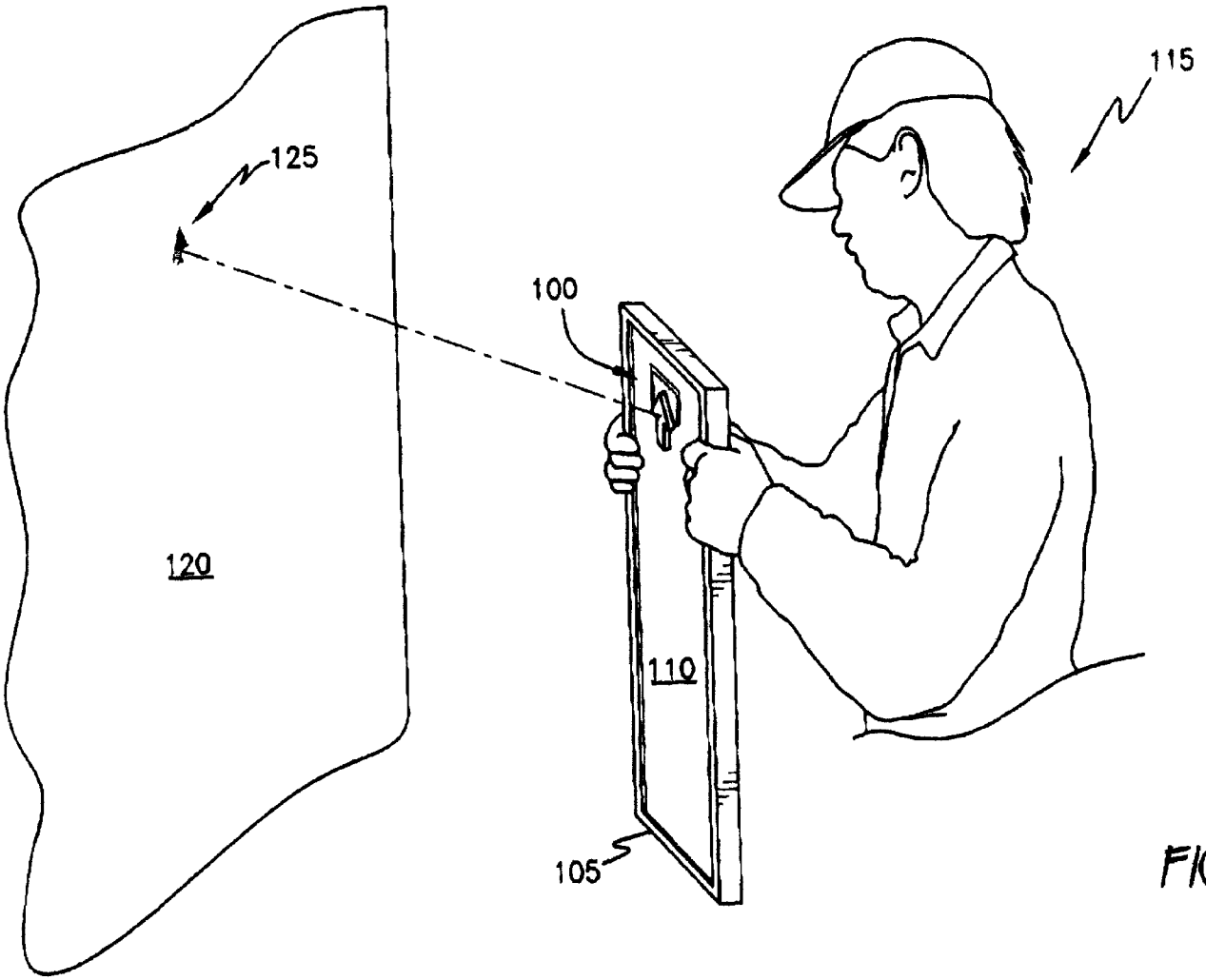
FIG. 1 is an environmental view of an individual using the marker of the present invention to mark a location on a supporting surface to place a fastener for hanging an object on the supporting surface.

The invention will now be described with reference to the above drawing, wherein like reference numerals refer to like features throughout the description.

With reference to FIG. 1, a person 115 is show using the marker 100 of the present invention to mark a location on a supporting surface 120 where a fastener (not shown) is to be placed. The fastener is to be used to hang the object 105. The marker 100 is adhesively attached to the back 110 of the object 105. The person 115 moves the object 105 until the person 115 or an observer (not shown) determines the object 105 to be in the desired position adjacent the supporting surface 120. By then pushing the object 105 against the supporting surface 120, the material of the marker 100 (preferably chalk) contacts the supporting surface and leaves a small mark 125. The object 105 can then be laid aside while a fastener (not shown) is attached to the supporting surface 120 at the location of the small mark 125. The small mark 125 is then easily removed. For purposes of this description "easily removed" means that the mark can be removed by wiping using a damp cloth or soap and water. The marker 100 is then removed from the back of the object 105 and the object is placed on the fastener to hang in the desired location.

Figure 2:
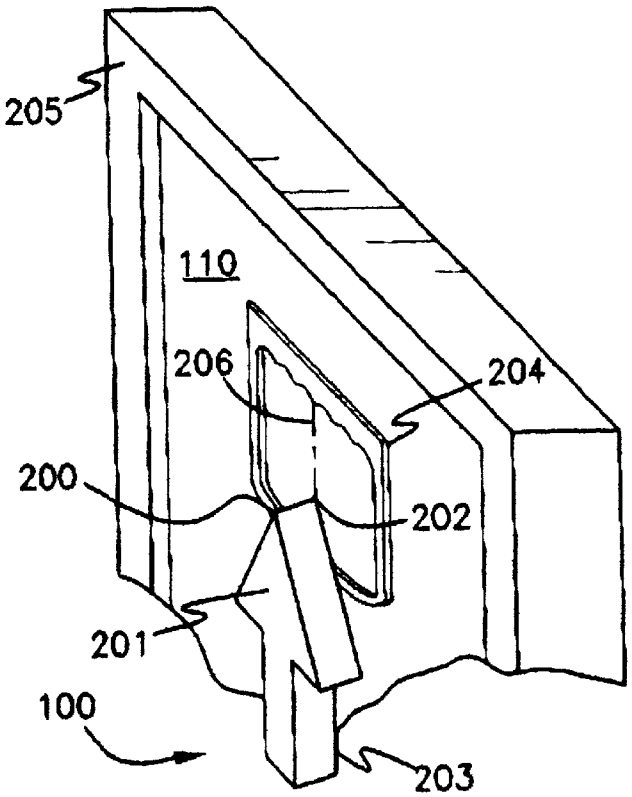
FIG. 2 is an elevational perspective view of a marker of this invention.

A more detailed description will now be given of the marker 100 of the first embodiment. FIG. 2 illustrates the temporary location of the marker 100 on the back 110 of the object 105 to be hung on the supporting surface 120. The marker 100 is preferably shaped like an arrow as shown, but may have any shape which includes a pointed tip 200 on the front surface 201 of the marker 100. The marker has a thickness and the front 201 and back 203 surfaces are of substantially equal dimensions. Therefore the marking pointed tip 200 on the front surface 201 of the marker 100 aligns with a second point 202 on the back surface 203 of the marker 100. When placing the marker 100 on the back 110 of the object 105, the second point 202 is placed directly on the location that a fastener (not shown) will engage the object 105. In the embodiment illustrated in FIG. 2, a hanger 204 is provided on the back 110 of the object 105 near or on a frame 205 that encircles the object 105, as is well known with pictures, certificates and mirrors. The hanger 204 includes a central groove 206 that is intended to rest on a fastener (not shown) secured to the supporting surface 120. If only one fastener is used, the hanger 204 is placed at the balance point of the object 105, usually at or near the center. The marker 100 of the present invention can be used with any number of fasteners by placing the marker 100 at each corresponding location. The second point 202 of the marker 100 is aligned with the central groove 206 and the marker 100 is gently pushed against the back 110 of the object 105 to adhesively attach the back surface 203 of the marker 100 to the back surface 110 of the object 105. It should be noted that the pointed tip 202 need not be exactly on the fastener location, as long as any offset is taken into account when securing the fastener relative to the mark 125 on the supporting surface 120. When the object 105 is pushed against the supporting surface 120, it is tilted slightly toward the supporting surface 120 so that the pointed tip 202 of the marker 100 is the first (or only) portion to touch the supporting surface 120. This results in marking an accurate location for a fastener.

Figure 3:
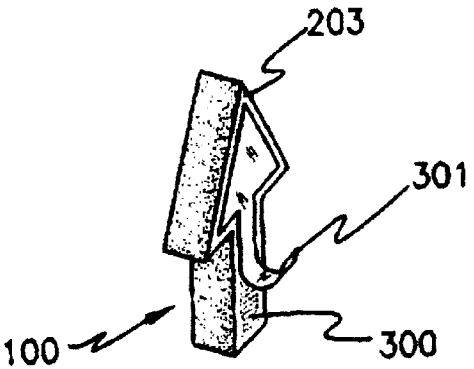
FIG. 3 is an elevational perspective view of the marker adhered to the back of an object to be mounted.

The details of the marker 100 are best shown with reference to FIG. 3. A layer of adhesive material 300 is provided on the back surface 203 to temporarily attach the marker 100 to the back of the object 105 to be hung. The adhesive material 300 is of the reusable variety, and substantially covers the back surface 203 of the marker 100. The specific adhesive material used is not critical, although the adhesive should be mildly tacky for easy removal and reapplication. A release liner 301 may also be used to protect the adhesive surface 300 when the marker 100 is not in use.

Other than the adhesive 300, the marker 100 is substantially a block or body made of suitable marking material and formed in a shape that includes at least one pointed tip 202 as described above. A suitable marking material is one which is solid, a finite portion of the material is left on the surface to be marked when slight pressure is applied, and the marked surface may be easily cleaned to remove the marking material. Chalk is the preferred marking material. Preferably, each marker 100 contains multiple pointed tips 202. Each contact with a supporting surface 120 removes a finite amount of marking material from the marker 100. Accordingly, the presence of more than one pointed tip 202 lengthens the lifespan of the marker 100. There should not be so many pointed tips 202 so as to cause multiple markings on a supporting surface 120. Three pointed tips 202 is ideal. The color of the marking material may vary, although specific colors may be more useful with mounting surfaces 120 having different colors. For example, a blue chalk similar to that used with construction chalk lines may be useful for most surfaces 120, but if the surface 120 is also blue, a marking material of a different color (such as white) would be more visible. The ultimate shape and color of the marker 100 can be tailored to leave a clear, distinct colored point where the fastener should be placed.

With reference to FIGS. 4–6, an alternate marker 100 capable of use with this invention will now be described. The marker 100 is made up of a main body 401 composed of a material which will not mark a supporting surface 120. This is preferably a plastic material. Adhered to this main body 401 is a pointed tip 402 which is composed of a material which will mark the supporting surface. This material is the same as that already described, and is preferably a solid chalk material or a marking material coated over the tip 402 of the main body 401. As seen in FIG. 6, the back surface 203 of the marker 100 is triangular in shape and is coated with an adhesive layer 403 which is covered by a release layer 404 having a pull tab 405 for easy removal. As in the first embodiment, the back surface 203 of the marker will be releasably adhered to the back surface 110 of the object 105 to be mounted. As evidenced by FIGS. 4 and 5, the back surface 203 of the marker has a measurable size (preferably about one-half inch) while the front of the marker which contains the marking material comes to a pointed tip 402. The top edge 406 is perpendicular to the back surface 203 and had dimensions which are comparatively larger than those of the back surface 203, preferably about one inch. In using the marker 100 of the second embodiment, the object 105 to be hung does not have to be tilted at all, or only to a slight degree, in order for the marker 100 to leave a finite amount of marking material on the supporting surface 120.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A combination comprising:

I) a solid marker for indicating a location to place a fastener for an object to be mounted on a supporting surface, wherein the marker comprises a) a front having at least one pointed tip which is made of a material such that the pointed tip will leave an easily removable, finite portion of the material on the supporting surface to be marked when slight pressure is applied, thereby producing a marked surface, and the marked surface may be easily cleaned to remove the marking material, and b) a back side containing a releasable adhesive layer, and II) an object to be mounted on a supporting surface, wherein the object to be mounted has a back side and a front side, the back side being releasably adhered to the back side of the marker.

2. The combination of claim 1, wherein the material of the marker comprises chalk.

3. The combination of claim 2, wherein the object to be mounted is a picture.

4. The combination of claim 1, wherein the solid marker has front and back sides which are of substantially equal dimensions and the marker comprises the solid marking material.

5. The combination of claim 4, wherein the marking material comprises chalk.

6. The combination of claim 1, wherein the solid marker has a back side, a front pointed tip and a main body of the marker positioned between the back side and the pointed tip.

7. The combination of claim 6, wherein the main body of the marker comprises material which will not mark the supporting surface.

8. The combination of claim 7, wherein the pointed tip comprises chalk.

9. In a method for determining the proper location for a fastener for an object to be mounted on a supporting surface, the improvement which comprises the steps of:

I) presenting a solid marker which comprises a) a front having a pointed tip made of a material such that the pointed tip will leave an easily removable, finite portion of the material on the supporting surface to be marked when slight pressure is applied, thereby producing a marked surface, and the marked surface may be easily cleaned to remove the marking material, and b) a back side containing a releasable adhesive layer, II) presenting an object to be mounted on a supporting surface, wherein the object to be mounted has a back side and a front side, III) releasably adhering the back side of the object to be mounted to the back side of the marker, IV) holding the object to be mounted adjacent the desired location of the supporting surface, V) pressing the object to be mounted and the adhered marker against the supporting surface so that the pointed tip of the marker leaves a visible, finite amount of material on the supporting surface, and VI) removing the object to be mounted away from the supporting surface.

10. The method a recited in claim 9, wherein the material of the marker comprises chalk.

11. The method as recited in claim 9, wherein the supporting surface is a wall.

12. The method as recited in claim 9, wherein the object to be mounted is a picture.

13. The method of claim 9, wherein the solid marker has front and back sides which are of substantially equal dimensions and the marker comprises the solid marking material.

14. The method of claim 13, wherein the marking material comprises chalk.

15. The method of claim 9, wherein the solid marker has a back side, a front pointed tip and a main body of the marker positioned between the back side and the pointed tip.

16. The method of claim 15, wherein the main body of the marker comprises material which will not mark the supporting surface.

17. The method of claim 16, wherein the pointed tip comprises chalk.

* * * * *